United States Patent [19]

Hirozumi et al.

[11] Patent Number: 4,879,491

[45] Date of Patent: Nov. 7, 1989

[54] ELECTRIC LAMP ASSEMBLY

[75] Inventors: Yasuo Hirozumi; Susumu Kanematsu; Yasuyoshi Numajiri; Mikio Watanabe; Mitsuhiro Okano, all of Shizuoka, Japan

[73] Assignee: Koito Seisakusho Co., Ltd., Tokyo, Japan

[21] Appl. No.: 215,537

[22] Filed: Jul. 6, 1988

[30] Foreign Application Priority Data

Jul. 6, 1987 [JP] Japan ..... 62-168388

[51] Int. Cl.[4] ..... H01J 5/48; H01J 5/50

[52] U.S. Cl. ..... 313/318; 362/211; 362/267; 362/362; 439/617

[58] Field of Search ..... 313/318, 49, 51; 362/211, 267, 362; 439/617

[56] References Cited

U.S. PATENT DOCUMENTS

| | | | |
|---|---|---|---|
| 3,960,278 | 6/1976 | Vause | 313/318 |
| 4,609,977 | 9/1986 | Eckhardt et al. | 362/267 |
| 4,631,651 | 12/1986 | Bergin et al. | 362/267 |
| 4,687,965 | 8/1987 | Sanders et al. | 313/318 |

*Primary Examiner*—Robert L. Griffin
*Assistant Examiner*—T. Salindong
*Attorney, Agent, or Firm*—Browdy and Neimark

[57] ABSTRACT

An electric lamp assembly is disclosed which comprises a bulb unit including a filament, lead lines extending from the filament to the outside of the bulb unit and a hermetic seal portion, the lead lines extending through the hermetic seal portion; a bulb holder including a looped band portion which gripps the hermetic seal portion of the bulb unit having leading ends of the lead lines projected outward from the bulb holder, the bulb holder having foot portions each being formed with at least one opening; and a base assembly including a circular body part, a pair of conducting plate members having leading ends projected outward from respective slits formed in the body part and a plurality of supporting pins extending outward from the body part. The supporting pins are inserted into the openings of the foot portions of the bulb holder and welded to the foot portions to achieve a tight connection between the base assembly and the bulb holder. In order to facilitate mating between the leading ends of the lead wires and the leading ends of the conducting plate members, there is further employed a guide structure which guides the leading ends of the lead wires to give portions of the conducting plate members upon coupling of the bulb holder and the base assembly.

6 Claims, 12 Drawing Sheets

ELECTRIC LAMP ASSEMBLY

BACKGROUND OF THE INVENTION

1. Field of the Invention

The present invention relates in general to electric lamp assemblies and more particularly to electric lamp assemblies of a type which comprises a bulb unit, a bulb holder, a core structure and a base structure of molded plastics.

2. Description of the Prior Art

For ease of understanding the task of the present invention, one of conventional electric lamp assemblies of the above-mentioned type will be outlined with reference to FIG. 13 of the accompanying drawings.

In the drawings, there is shown but partially a conventional electric lamp assembly "a". The assembly "a" comprises an electric bulb "b" in which a filament (not shown) is installed. Designated by references "c" are lead wires which extend from respective ends of the filament and are projected outwardly from one end of the bulb "b" to constitute exposed terminal ends "c'" thereof. Designated by reference "d" is a bulb holder which holds at its one end portion the bulb "b". Designated by reference "e" is a base structure from which a plurality of supporting pins "f" and a pair of conducting terminal plates "g" extend toward the bulb holder "d". The supporting pins "f" are welded to the bulb holder "d" to achieve a tight mechanical connection between the base structure "e" and the bulb holder "d". The terminal plates "g" are welded to the exposed terminal ends "c'" of the lead wires "c" thereby to achieve an electric connection between the terminal plates "9" and the filament in the bulb "b".

However, due to inherency in construction, the above-mentioned conventional electric lamp assembly "a" has a certain drawback which arises during assembling process thereof.

When mounting of the electric bulb "b" onto the base structure "e" is being carried out, it is difficult or at least troublesome to mate the exposed terminal ends "c'" with the corresponding terminal plates "g". That is, if the exposed terminal ends "c'" have been bent for some reasons, as is shown by the broken lines in FIG. 13, before or during the assembling process, accurate mating of the exposed terminal ends "c'" with the terminal plates "g" becomes impossible. In fact, this tends to occur because the lead wires "c" are constructed of a very flexible thin wire. That is, once the mounting of the bulb "b" onto the base structure "e" is carried out with the exposed termain ends "c'" remained bent, the subsequent welding process fails to properly weld the terminal ends "c'" to the corresponding terminal plates "g". Of course, this induces malfunction of the lamp assembly "a".

SUMMARY OF THE INVENTION

It is therefore an essential object of the present invention to provide an improved electric lamp assembly which is free of the above-mentioned drawback.

According to the present invention, there is provided an electric lamp assembly which is equipped with a guide structure by which the exposed terminal ends of the lead wires are properly guided to proper positions when the electric bulb is mounted onto the base structure.

According to the present invention, there is provided an electric lamp assembly. The assembly comprises a bulb unit including a filament, lead lines extending from the filament to the outside of the bulb unit and a hermetic seal portion, the lead lines extending through the hermetic seal portion; a bulb holder including a looped band portion which gripps the hermetic seal portion of the bulb unit having leading ends of the lead lines projected outward from the bulb holder, the bulb holder having foot portions each being formed with at least one opening; a core structure of molded plastics including a circular plate portion and a plurality of supporting pins which extend from the circular plate portion, the supporting pins being inserted into the openings of the foot portions of the bulb holder and welded to the foot portions to achieve a tight connection between the core structure and the bulb holder, the circular plate portion being formed with two slits; a base structure of molded plastics having a hollowed entrance into which the core structure is snugly received, the base structure including two conducting plate members which are inserted through and projected from the slits of the circular plate portion to be welded with the lead lines; and guide means for guiding the leading ends of the lead lines to given portions of the conducting plate members upon coupling of the core structure and the bulb holder.

BRIEF DESCRIPTION OF THE DRAWINGS

Other objects and advantages of the present invention will become apparent from the following description when taken in conjunction with the accompanying drawings, in which:

FIGS. 1 to 8B are drawings showing an electric lamp assembly of a first embodiment of the present invention, in which:

FIG. 1 is an exploded perspective view of the electric lamp assembly of the first embodiment;

FIG. 2 is a perspective view of the electric lamp assembly in an assembled condition;

FIG. 3 is an enlarged exploded view of the electric lamp assembly with some parts removed;

FIG. 4 is a vertically sectional view of the electric lamp assembly;

FIG. 5 is a sectional view taken along the line V—V of FIG. 4;

FIG. 6 is an enlarged sectional view taken along the line VI—VI of FIG. 5;

FIG. 7 is an enlarged sectional view taken along the line VII—VII of FIG. 5; and FIGS. 8A and 8B are enlarged views of a portion indicated by the arrow "VIII" of FIG. 4, showing different conditions of the same; and FIGS. 9 to 12 are drawings showing an electric lamp assembly of a second embodiment of the present invention, in which:

FIG. 9 is an exploded perspective view of the electric lamp assembly of the second embodiment;

FIG. 10 is a vertically sectional view of the electric lamp assembly of the second embodiment;

FIG. 11 is an enlarged sectional view taken along the line XI—XI of FIG. 10;

FIG. 12 is an enlarged exploded view of the electric lamp assembly with some parts removed.

DETAILED DESCRIPTION OF THE INVENTION

In the following, two embodiments of the present invention will be described in datail with reference to the accompanying drawings. Throughout the description and drawings, like parts and constructions are designated by the same numerals.

Figure 1:
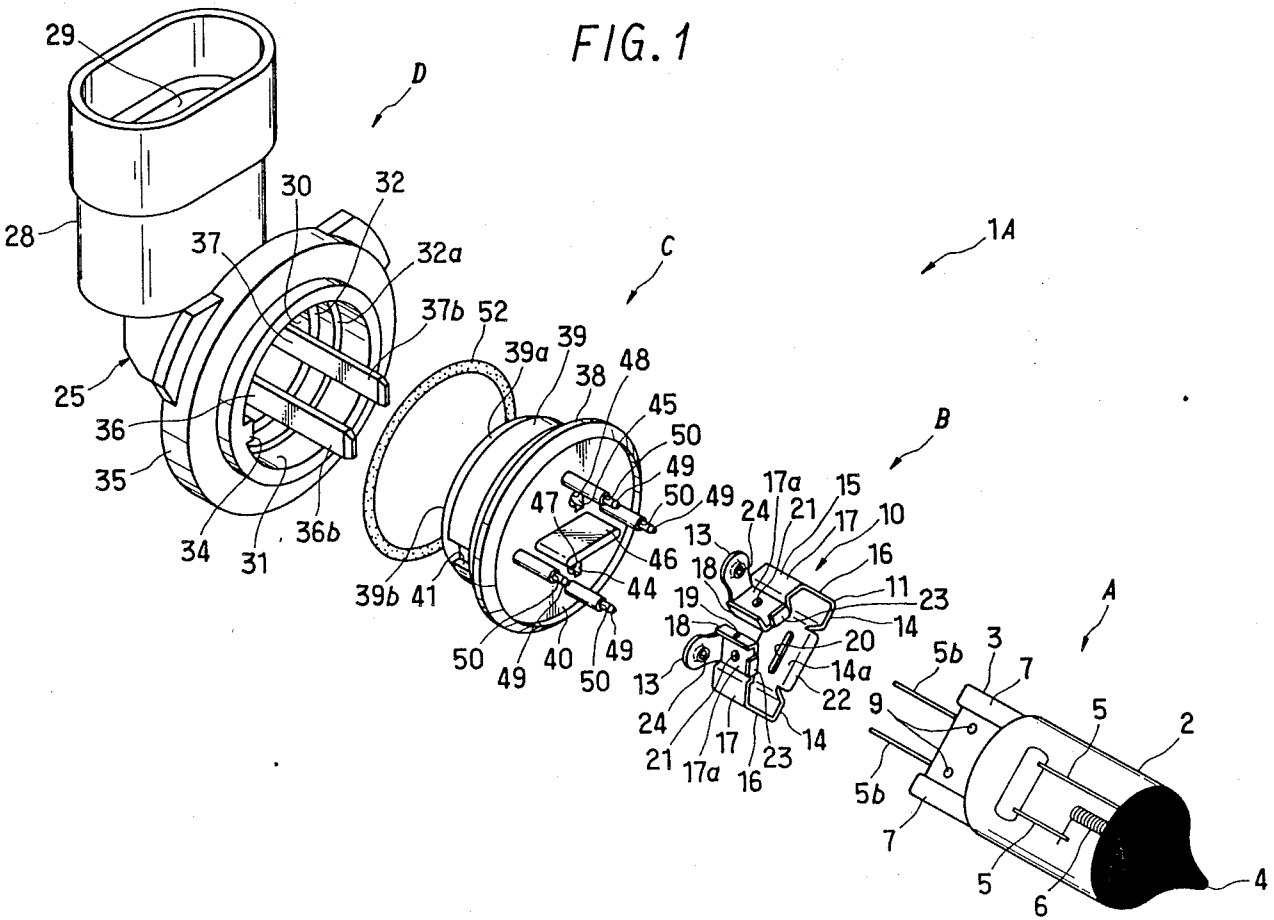
Figure 2:
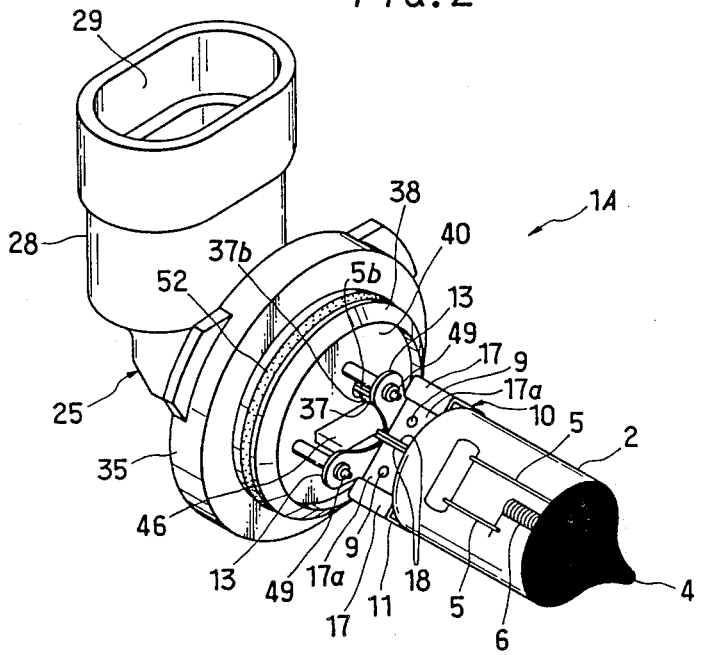
Figure 3:
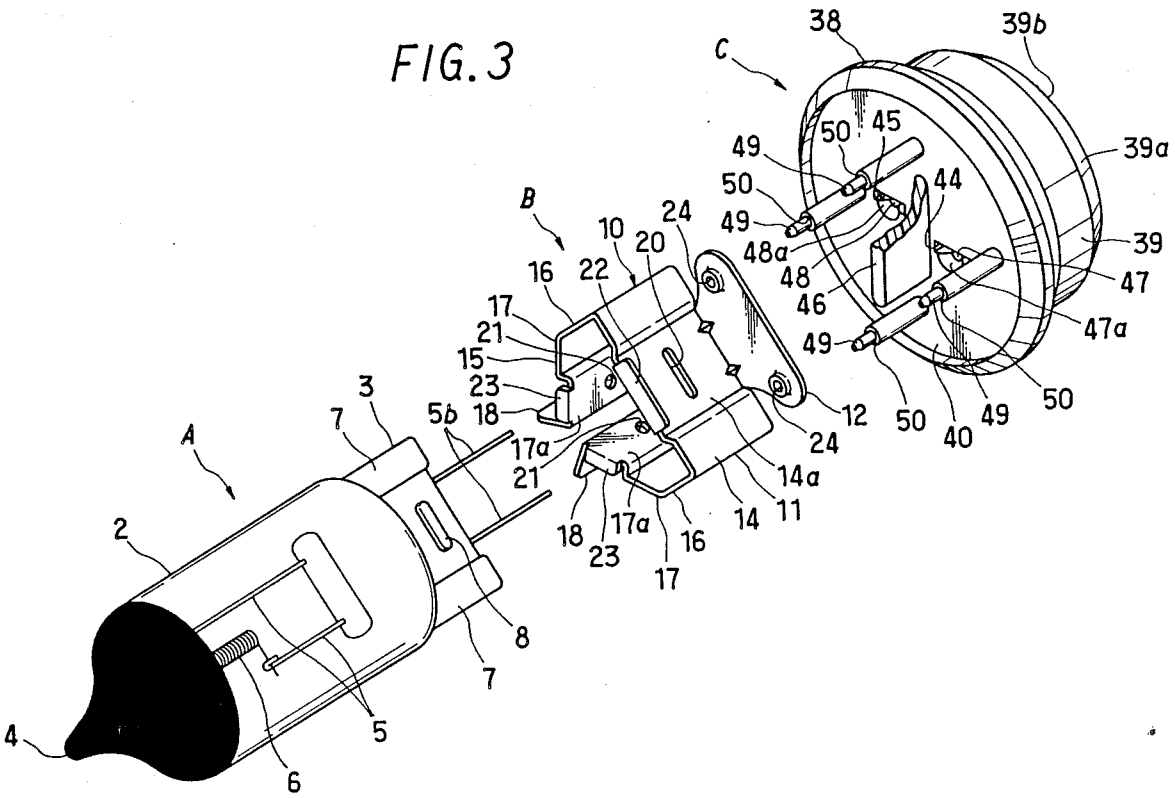

Referring to FIGS. 1 to 8B, particularly FIG. 1, there is shown an electric lamp assembly 1A of a first embodiment of the present invention.

As is seen from FIG. 1, the electric lamp assembly 1A comprises generally four major parts, viz., a bulb unit A, a bulb holder B, a core structure C and a base structure D which are assembled in a manner as will be described hereinafter. For ease of understanding, these major parts will be individually described and followed by the manner how these four major parts are assembled into the electric lamp assembly 1A.

As is best seen from FIG. 1, the bulb unit A comprises a halogen bulb 2 terminating in a rectangular hermetic seal 3 at one end and in a conical exhaust tip 4 at the other end. The hermetic seal 3 is formed with enlarged opposed bank portions 7. The hermetic seal 3 is formed at one side with two small projections 9 and at the other side (see FIG. 3) with an elongate projection 8. The halogen bulb 2 contains therein an inert gas and a given amount of halogen. A filament 6 is held in the bulb 2, which is supported by a pair of lead lines 5. The lead lines 5 are anchored in and extend outwardly from the hermetic seal 3 to provide exterior leads **5*b***.

The bulb holder B is entirely constructed of a pressed metal plate, which functions to hold the bulb unit A and mount the same to the core structure C. The bulb holder B comprises a rectangularly looped band portion 11, two smaller foot portions 13 and a larger foot portion 12 (see FIG. 3). As is seen from the drawings, the band portion 11 is sized and constructed to surround or grip the rectangular hermetic seal 3 of the bulb unit A and has opposed flat ends 18. That is, the band portion 11 comprises two identical channel portions which are arranged at opposed sides of a flat base portion **14*a*. Each channel portion includes three walls 14, 16 and 15. The wall 15 includes a projected part 17 and a depressed part 17*a* which are connected through a stepped part. The depressed part 17*a* has the smaller foot portion 13 and the flat end 18 integrally connected thereto. The depressed part 17*a* has further a lug 23 at its front edge and a small opening 21 at its major portion. The smaller foot portion 13 is formed at its leading end with an opening 24. One of the flat ends 18 is formed with a small projection 19 which projects toward the other. The flat base portion 14*a* is formed at its major part with an elongate opening 20 and at its front end with a flange 22. As is seen from FIG. 3, the larger foot portion 12 is formed at its outside portions with two spaced openings 24. The openings 24 of the larger and smaller foot portions 12 and 13 are each defined by a small ring secured thereto. The larger and smaller foot portions 12 and 13 extend radially outwardly from the band portion 11**.

For coupling the bulb holder B and the afore-mentioned bulb unit A, the band portion 11 of the bulb holder B is put around the hermetic seal 3 of the bulb unit A and then the opposed flat ends 18 of the bulb holder B are welded by means of a spot welding method. The small projection 19 on one of the flat ends 18 promotes the welding.

With this procedure, the bulb holder B is tightly fixed to the bulb unit A with an assured positioning relative thereto. That is, a bulb assembly (A+B) is provided in which the small projections 9 and the elongate projection 8 of the hermetic seal 3 are snugly received in the small openings 21 and the elongate opening 20 of the band portion 11, and the lugs 23 of the band portion 11 support thereon a bottom of the bulb proper.

The core structure C is a member which is to be snugly put in the base structure D as will be described hereinafter. The core structure C comprises generally a collar portion 39 and a circular plate portion 40 which are of a monoblock molded construction of thermoplastic resin and coaxially arranged with each other. The collar portion 39 is formed at its outer cylindrical surface with an axially extending groove 41, and the circular plate portion 40 has a diameter somewhat greater than the outer diameter of the collar portion therby to form thereon an annular ridge 38, as is best seen from FIG. 3. The collar portion 39 is formed with a tapered portion **39*a* which terminates at a rear end 39*b* of the collar portion 39. The circular plate portion 40 is formed at its center part with two rectangular slits 44 and 45. The inward end of each slit 44 or 45 is somewhat enlarged or chamferred for facilitaing insertion of an after-mentioned conducting plate 36 or 37** of the base structure D thereinto.

For the purpose which will become apparent as the description proceeds, the circular plate portion 40 is further formed with two bores 47 and 48 which extend along the slits 44 and 45 and are merged therewith respectively. The mouth portion of each bore 47 or 48 is chamferred and denoted by numeral **47*a* or 48*a* in FIG. 3. A partition wall 46 is integrally formed on the circular plate portion 40 at a position between the slits 44 and 45**.

Four equally spaced supporting pins 49 extend in parallel outwardly from the circular plate portion 40. These pins 49 are sized and arranged to mate with the openings 24 of the smaller and larger foot portions 13 and 12 of the afore-mentioned bulb holder B. Each pin 49 has a base portion tightly embedded in the circular plate portion 40 and has a stepped portion 50 at the leading end.

Figure 4:
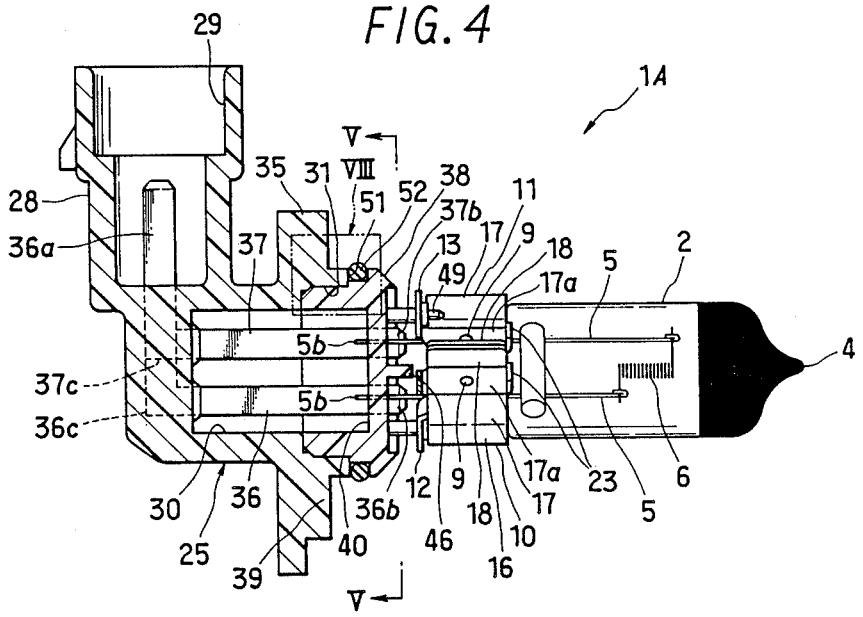
Figure 5:
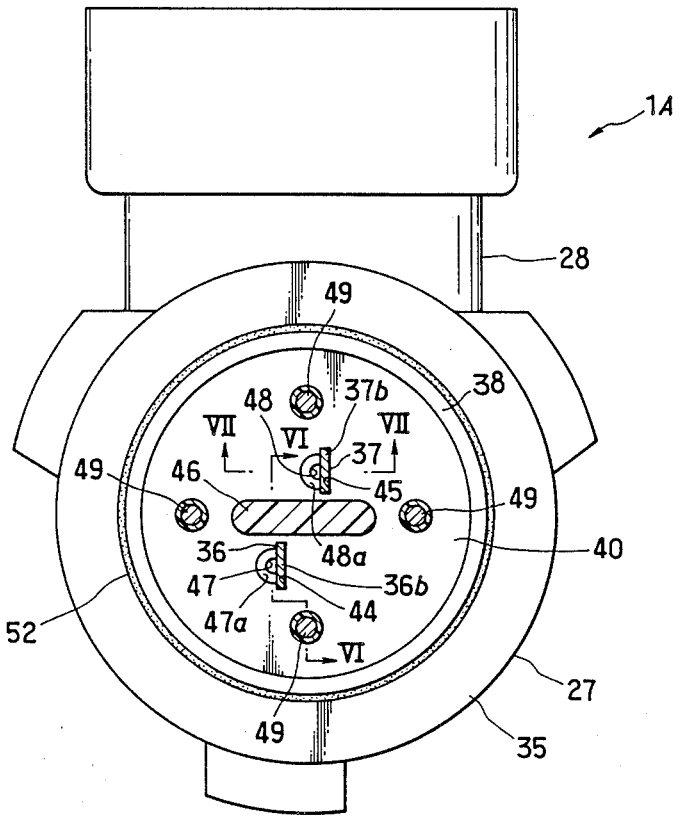
Figure 6:
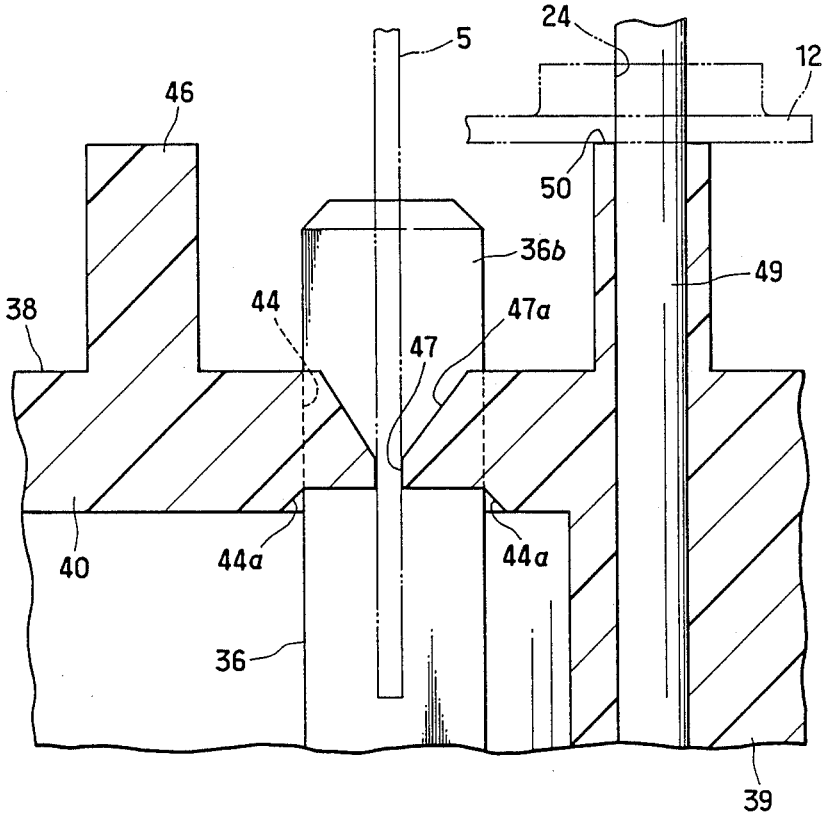
Figure 7:
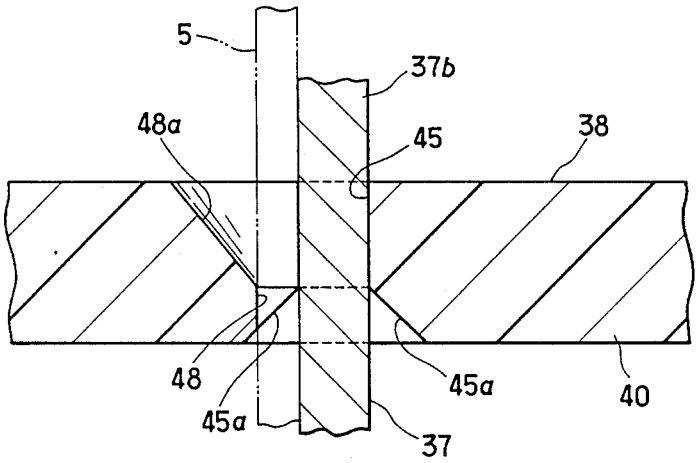

Designated by numeral 52 is a seal ring which is to be disposed about the collar portion 39 of the core structure C, as will be understood from FIG. 4.

The base structure D is of a monoblock molded plastic member, which comprises a hollow major portion 35 and a sleeve portion 28 which are connected at generally right angles with an interposal of a solid portion 25 therebetween. The hollows of the major and sleeve portions 35 and 28 are designated by numerals 30 and 29 respectively. As is best seen from FIG. 1, the hollow 30 of the major portion 35 has an enlarged entrance 31 which is sized to snugly receive therein the collar portion 39 of the above-mentioned core structure C. An axially extending key projection 34 is formed on the inner cylindrical surface of the enlarged entrance 31. As will become apparent as the description proceeds, the key projection 34 is mated with the groove 41 of the core structure C upon coupling of the core structure C and the base structure D. The hollow 30 of the major portion 35 is formed with first and second annular stepped portions **32*a* and 32. As is seen from FIG. 8B, upon proper coupling of the core structure C and the base structure D, the bottom 39*b* of the core structure C is seated on the second annular stepped portion 32**.

As is seen from FIG. 4, two generally L-shaped conducting plates 36 and 37 are stationarily disposed in the base structure D. Each conducting plate 36 or 37 is anchored at a middle bent portion in the solid portion 25 having opposed portions 36*b* and 36*a* (or 37*b* and 37*a*) projected outwardly through the hollows 30 and 29, respectively. For ease of understanding, portions of the conducting plates 36 and 37 which are located in the hollow major portion 35 will be referred to as "horizontal plate portions" 36*b* and 37*b*, while, portions which are located in the sleeve portion 28 will be referred to as "vertical plate portions" 36*a* and 37*a*. As is seen from FIG. 4, the conducting plates 36 and 37 have middle portions 36*c* and 37*c* which are bent away from each other to provide a given distance between the two vertical plate portions 36*a* and 36*b* in the sleeve portion 29. As is seen from FIG. 1, the horizontal plate portions 36*b* and 37*b* are somewhat projected outwardly from the major portion 35 of the base structure C. The leading end of each horizontal plate portion 36*b* or 37*b* is tapered.

For coupling the core structure C and the base structure D, the following steps are taken.

The collar portion 39 is snugly inserted in the enlarged entrance 31 of the hollow major portion 35 having the groove 41 of the core structure C mated with the key projection 34 of the hollow major portion 35. It is to be noted that the engagement between the groove 41 and the key projection 34 brings about an assured relative positioning therebetween. If desired, a suitable sealing agent (such as a silicone varnish or the like) may be applied to the collar portion 39 before insertion of the collar portion 39 into the base structure D in order to assure an airtight sealing therebetween. During the insertion of the collar portion 39, the leading ends of the horizontal plate portions 36*b* and 37*b* are inserted into and then projected outward from the rectangular slits 44 and 45 of the core structure C. Then, a supersonic welding is applied to the contacting surfaces of the combined structres C and D to achieve assured bonding therebetween. With this, a base assembly (C+D) is provided.

Then, the seal ring 52 is put in an annular groove 51 which is defined between the coupled two structures C and D.

Figure 8A:
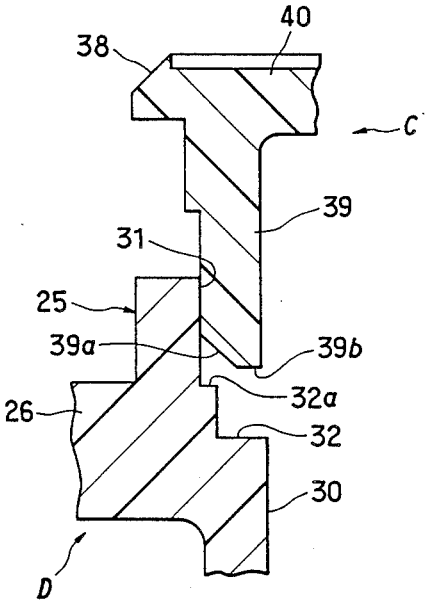
Figure 8B:
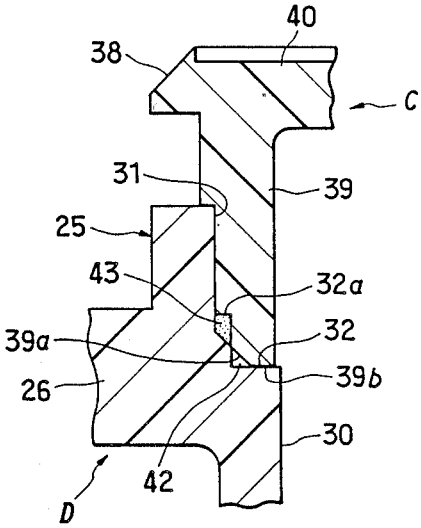

The manner in which the welding is carried out will be outlined with reference to FIGS. 8A and 8B.

FIG. 8A shows a condition wherein the collar portion 39 of the core structure C is being inserted into the enlarged entrance 31 of the base structure D. When the tapered portion 39*a* of the collar portion 39 comes to a position to contact with the shoulder part of the first annular stepped portion 32*a* of the hollow 30, a suitable biasing force is applied to the collar portion 39 to press the same against the shoulder part. Then, a supersonic vibration is applied to the contacting portions. Thus, the portions to which the vibration is applied are melted causing movement of the collar portion 39 into the hollow 30 due to the biasing force applied thereto. Thus, upon completion of the welding, the rear end 39*b* of the collar portion 39 is seated on the second annular stepped portion 32 of the hollow 30, as is shown in FIG. 8B. Designated by numeral 43 in FIG. 8B is the melted portions through which the two structures C and D are bonded. Designated by numeral 42 is an annular clearance into which a remaining melted portions may flow. Thus, the core structure C and the base structure D are properly coupled with a precise relative positioning therebetween.

For coupling the afore-mentioned bulb assembly (A+B) and the base assembly (C+D), the following steps are taken.

First, the four supporting pins 49 projected from the base assembly (C+D) are put into the respective openings 24 of the larger and smaller foot portions 12 and 13, and then, they are slid through the openings 24 to a given position where a given distance between the flange 35 of the base assembly (C+D) and the filament 6 of the bulb unit A is effected. Then, the four supporting pins 49 are welded to the corresponding smaller and larger foot portions 12 and 13 by means of a plazma arc welding method or the like.

Thus, the bulb unit A is tightly fitted to the base assembly (C+D) through the bulb holder B and the supporting pins 49. It is to be noted that because of provision of the stepped portions 50 of the pins 49, the positioning of the bulb holder B relative to the base assembly (C+D) is easily and assuredly achieved. That is, extreme inclination of the bulb holder B relative to the pins 49 does not occur.

Then, the exterior leads 5*b* from the bulb unit A are welded, by means of a spot welding method, to the projected ends of the horizontal plate portions 36*b* and 37*b* of the base assembly (C+D).

With these steps, the electric lamp assembly 1A of the first embodiment is produced.

It is to be noted that when the bulb assembly (A+B) is mounted to the base assembly (C+D) in the above-mentioned manner, the exterior leads 5*b* of the bulb unit A are inserted into the chamferred bores 47 and 48 of the circular plate portion 40 of the base assembly (C+D). This means that when the two assemblies (A+B) and (C+D) are coupled properly, the exterior leads 5*b* are automatically placed beside the corresponding horizontal plate portions 36*b* and 37*b* of the conducting plates 36 and 37. Thus, the spot welding applied to them can be easily and assuredly carried out.

Referring to FIGS. 9 to 12, there is shown an electric lamp assembly 1B of a second embodiment of the present invention.

Figure 9:
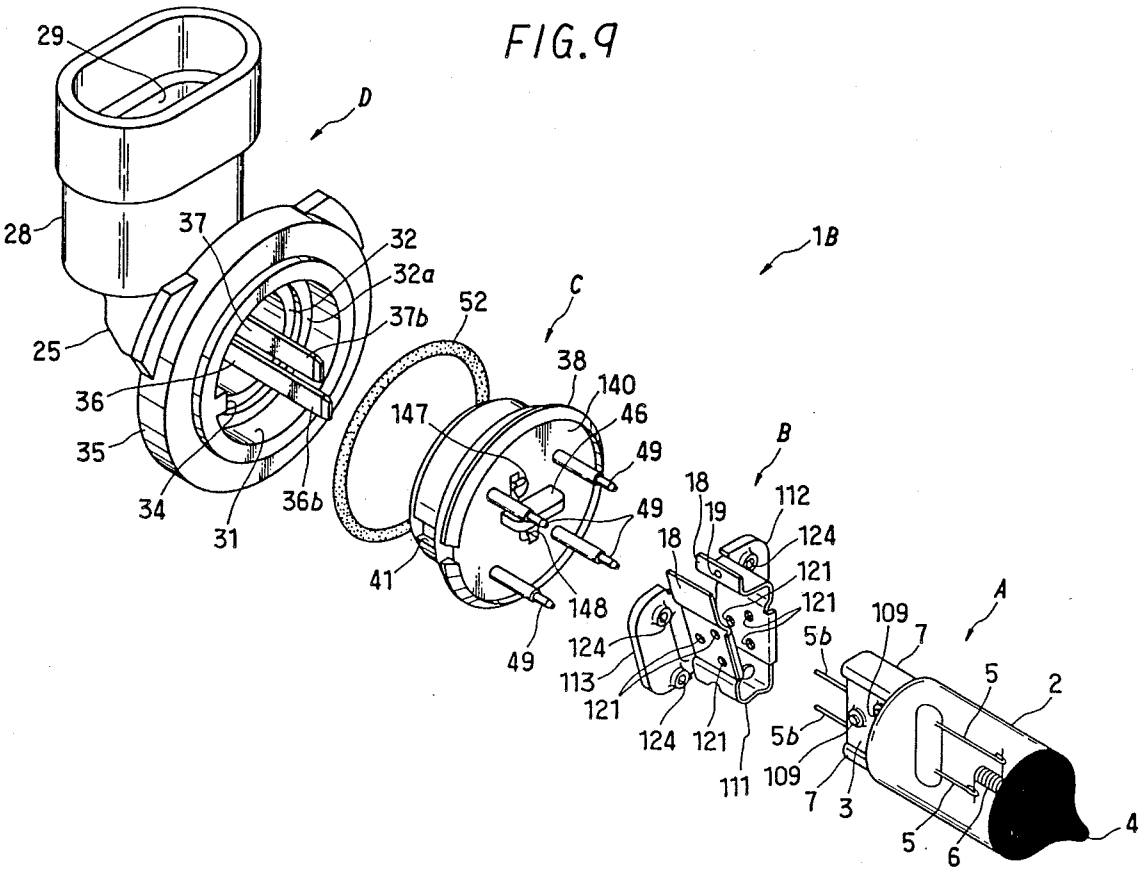
Figure 10:
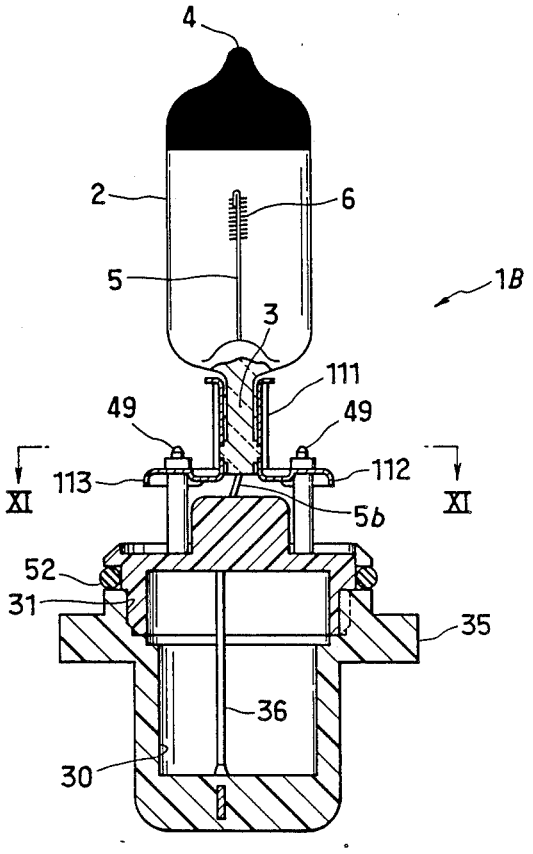
Figure 11:
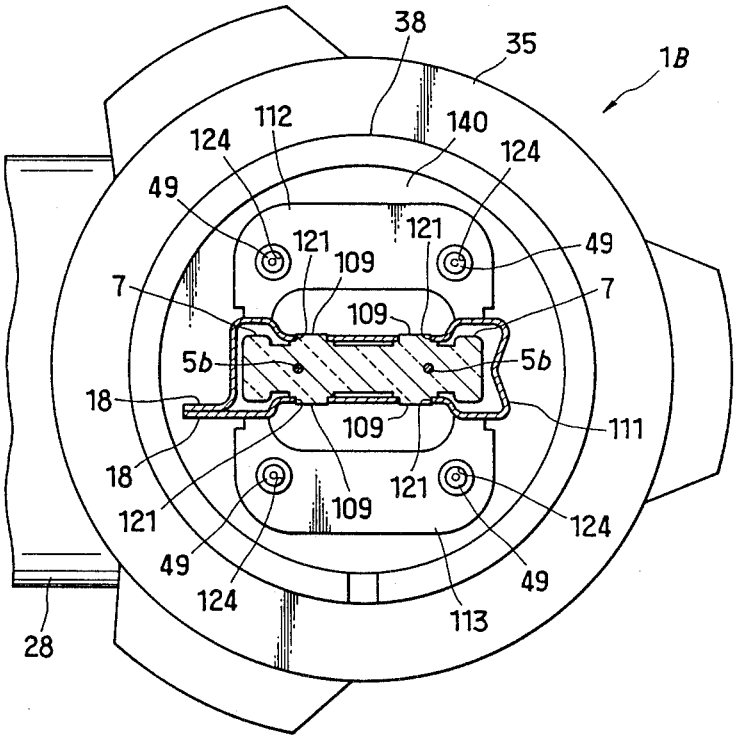

As is seen from FIG. 9, the lamp assembly 1B of the second embodiment is similar to that of the above-mentioned first embodiment 1A. Thus, the following description on the second embodiment will be directed to only the parts and constructions which are different from those of the first embodiment. The parts and constructions which are substantially the same as those of the first embodiment are denoted by the same numerals as in the first embodiment.

Figure 12:
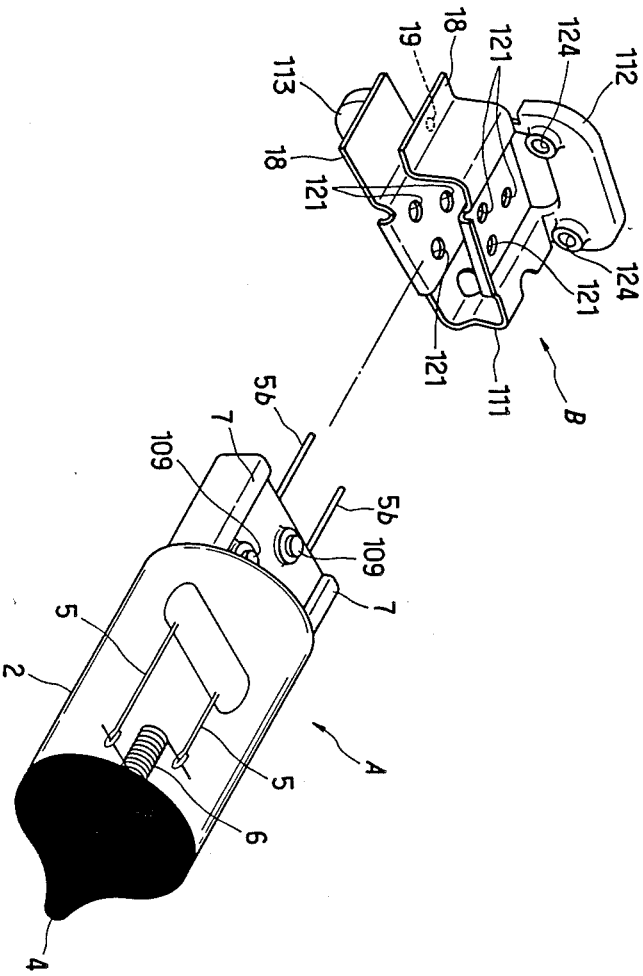
Figure 13:
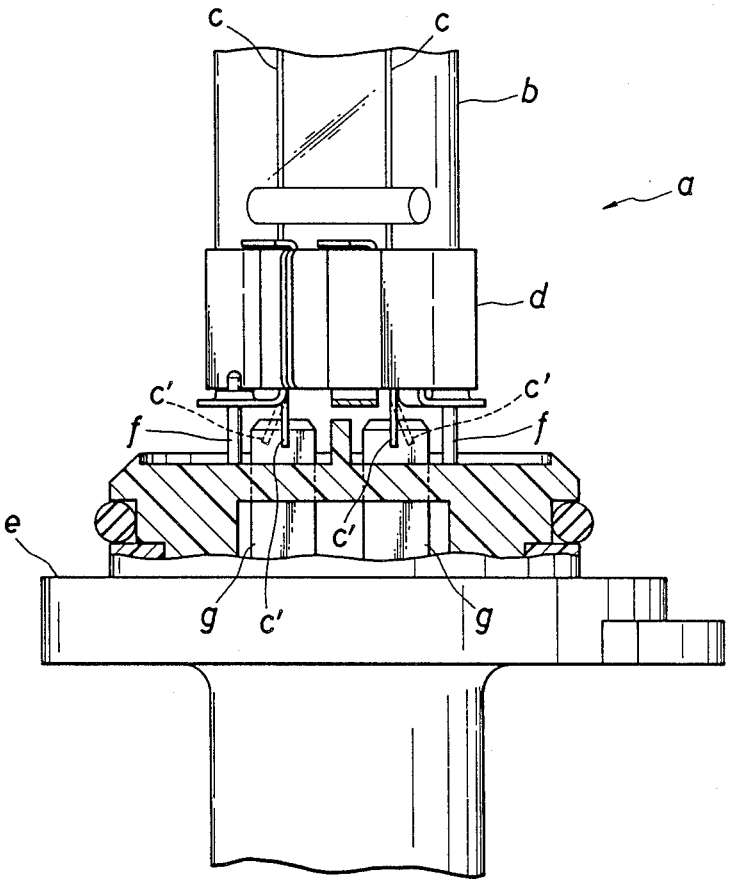
FIG. 13 PRIOR ART
FIG. 13 is a partial sectional view of a conventional electric lamp assembly.

That is, as is best understood from FIG. 12, in the second embodiment, the hermetic seal 3 of the bulb 2 is formed at each side with three projections 109 each having an annular stepped portion (no numeral). The bulb holder B has two larger foot portions 112 and 113 each having two openings 124 which correspond to the openings 24 of the first embodiment. Opposed depressed parts (no numerals) of the band portion 111 are each formed with three openings 121 with which the projections 109 of the hermetic seal 3 are engaged upon coupling of the bulb holder B and the bulb unit A. Also, in this embodiment, the circular plate portion 140 of the core structure C is formed with two chamferred bores 147 and 148 which correspond to the bores 47 and 48 of the first embodiment. Thus, substantially the same advantage as that in the first embodiment is possessed by the second embodiment.

What is claimed is:

1. An electric lamp assembly comprising:

a bulb unit including a filament, lead lines extending from said filament to the outside of the bulb unit and a hermetic seal portion, said lead lines extending through said hermetic seal portion;

a bulb holder including a looped band portion which grips the hermetic seal portion of the bulb unit having the leading ends of said lead lines projected outward from said bulb holder, said bulb holder having radially outwardly extending foot portions each having at least one opening formed therethrough;

a core structure including a circular plate portion of molded plastic and supporting pins which extend from said circular plate portion, said supporting pins being respectively inserted into said openings of said foot portions of said bulb holder and welded to the foot portions to achieve a tight connection between said core structure and said bulb holder;

a base structure having a hollowed entrance into which said core structure is snugly received, said base structure having two conducting plate members contained therein, said conducting plate members being welded with said lead lines; and guide means for guiding the leading ends of said lead lines and those of said conducting plate members thereby to facilitate the welding between said conducting plate members and said lead lines upon assembling the electric lamp assembly; and wherein said guide means comprises:

first means defining in said circular plate portion two slits for receiving the respective leading ends of said conducting plate members; and second means defining in said circular plate portion two bores for receiving the respective leading ends of said lead lines, said bores extending along and being merged with said slits respectively.

2. An electric lamp assembly as claimed in claim 1, in which said guide means comprises means defining in said circular plate portion two bores which extend along said slits respectively and are merged therewith.

3. An electric lamp assembly as claimed in claim 2, in which each of said bores is formed with a chamferred mouth portion which faces toward said lead lines.

4. An electric lamp assembly as claimed in claim 3, further comprising a partition wall which is integrally mounted on said circular plate portion at a position between said two bores.

5. An electric lamp assembly as claimed in claim 4, further comprising first positioning means by which said bulb unit and said bulb holder are connected with an assured relative positioning therebetween.

6. An electric lamp assembly as claimed in claim 5, in which said first positioning means comprises a plurality of projections formed on said hermetic seal portion, and a plurality of openings formed in said bulb holder, wherein upon proper coupling of said bulb holder and said bulb unit, said projections are engaged with said openings respectively.

* * * * *